US005975043A

United States Patent [19]

Bloomquist

[11] Patent Number: 5,975,043

[45] Date of Patent: Nov. 2, 1999

[54] DOUBLE SHAFT HIGH TORQUE ENGINE

[76] Inventor: Victor Rudolph Bloomquist, 13718 NE. 182 Ave., Brush Prairie, Wash. 98606

[21] Appl. No.: 09/047,582

[22] Filed: Mar. 25, 1998

[51] Int. Cl.[6] ..... F02B 75/32

[52] U.S. Cl. ..... 123/197.4

[58] Field of Search ..... 123/197.1, 197.4, 123/197.3

[56] References Cited

U.S. PATENT DOCUMENTS 2,314,789 3/1943 Jacobsen ..... 123/197.4
4,505,239 3/1985 Deland ..... 123/197.4
4,690,113 9/1987 Deland ..... 123/197.4
5,680,840 10/1997 Mandella ..... 123/197.4

*Primary Examiner*—Noah Kamen

[57] ABSTRACT

An engine has a pair of a pair of parallel crankshafts having a cross shaft connected at one to a journal on one of the crankshafts. The cross shaft has a slot in which a distance compensator mounted on a journal of the other of the crankshafts oscillates. A piston connecting rod is attached to the cross shaft at an intermediate portion of the cross shaft. The crankshafts rotate in the same direction and at the same speed; however, the one of the crankshafts is advanced with respect to the other. The journals are located at different radiuses.

4 Claims, 7 Drawing Sheets

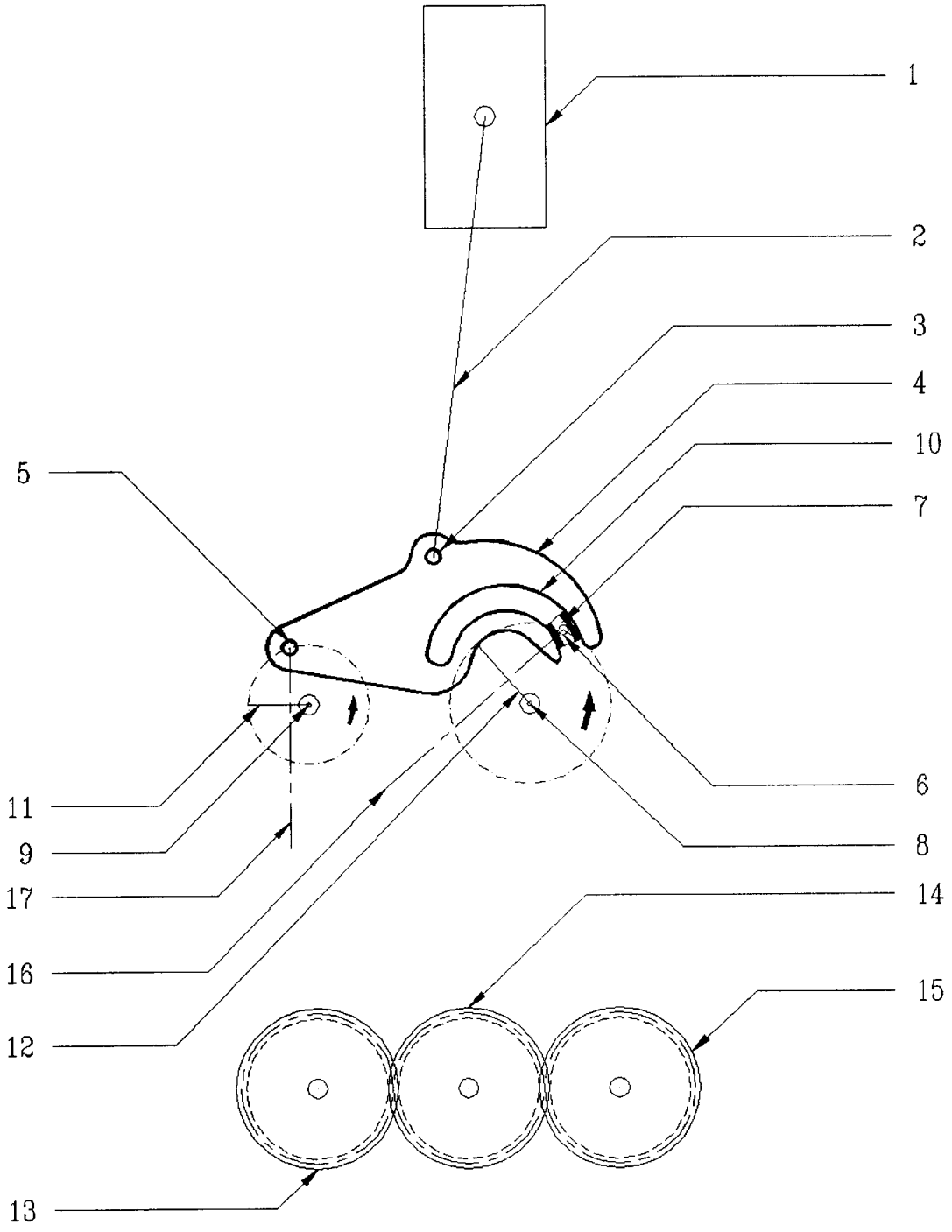
DRAWING 1

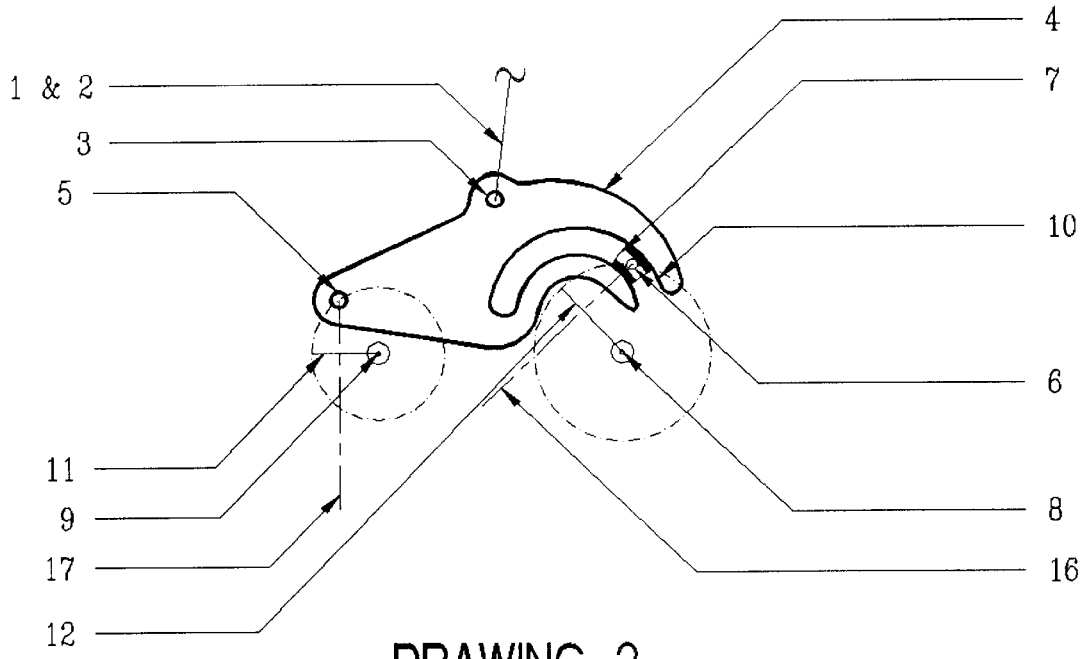
DRAWING 2
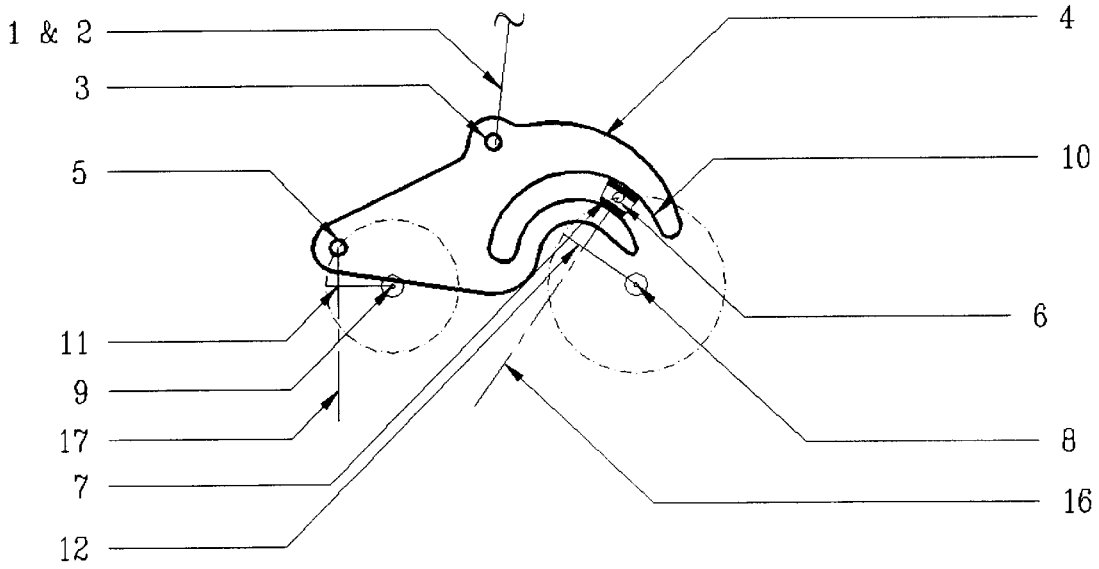
DRAWING 2A

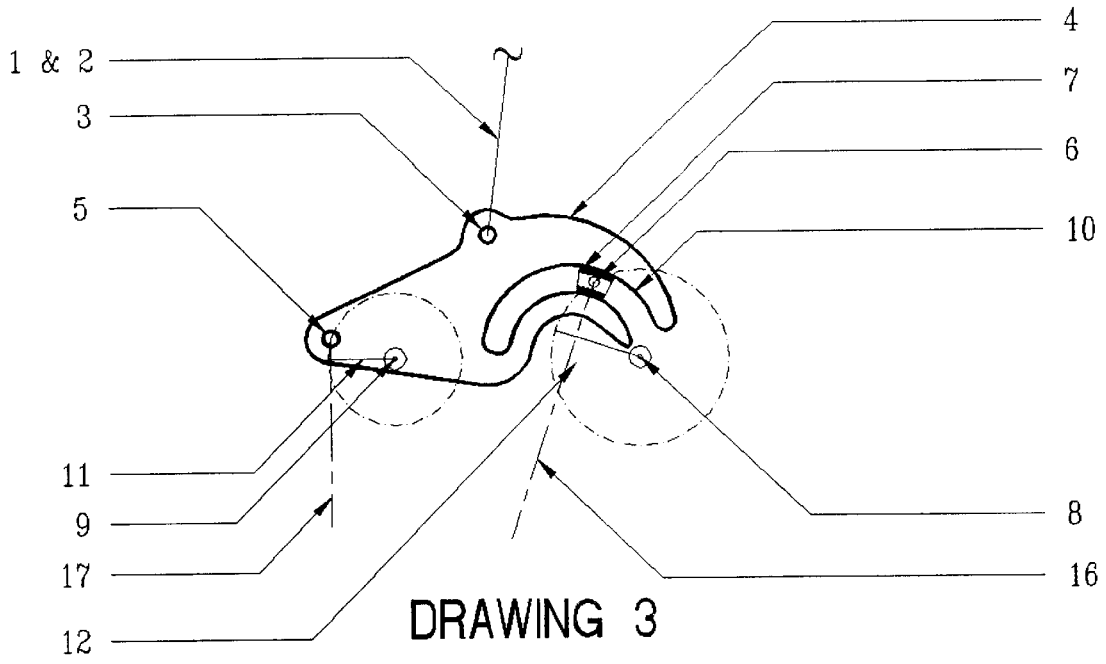
DRAWING 3
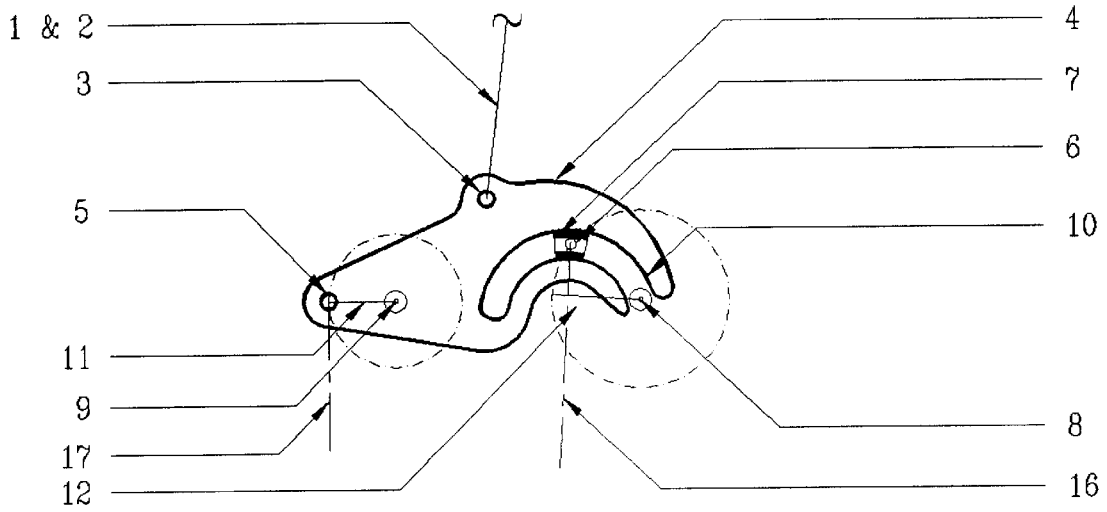
DRAWING 3A

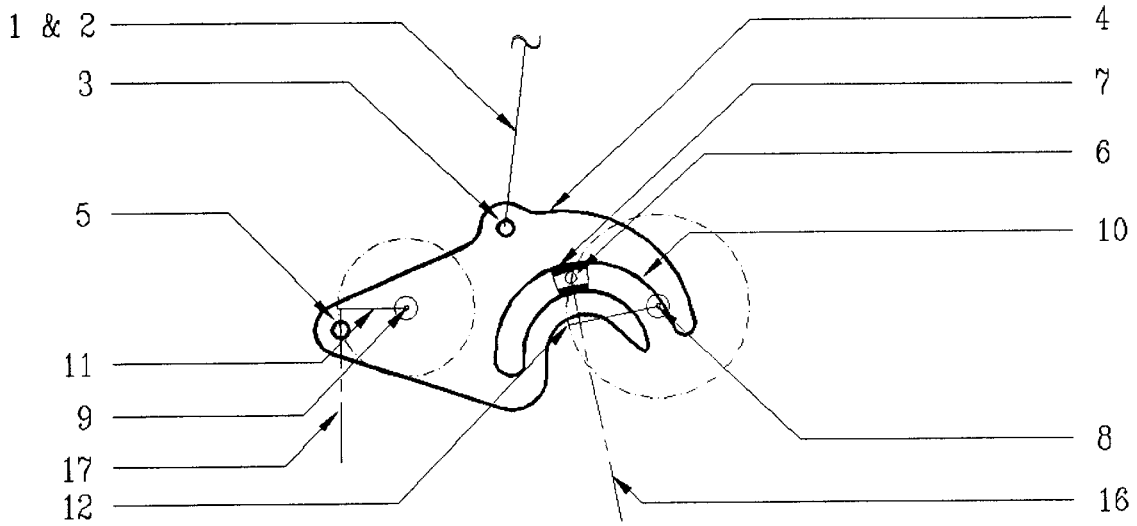
DRAWING 4
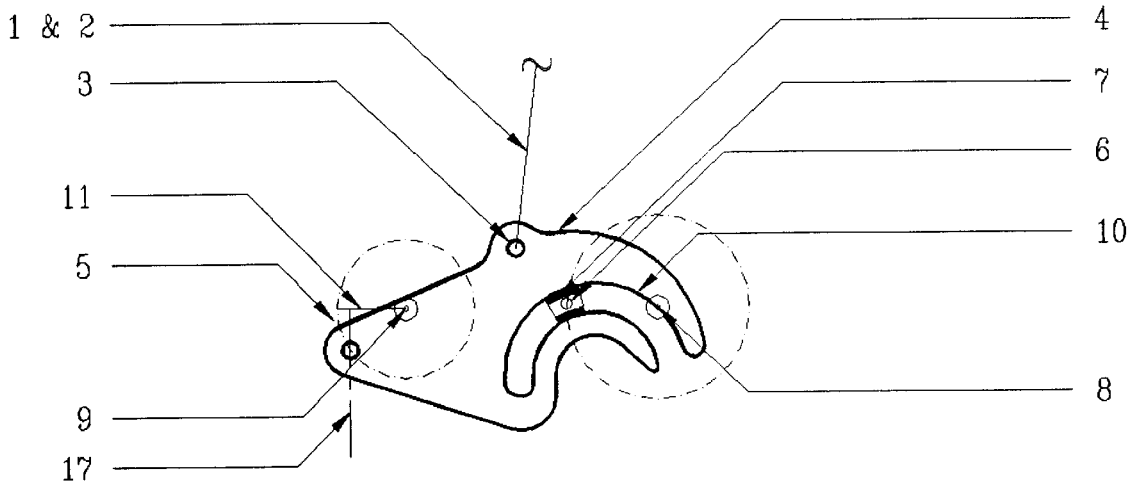
DRAWING 4A

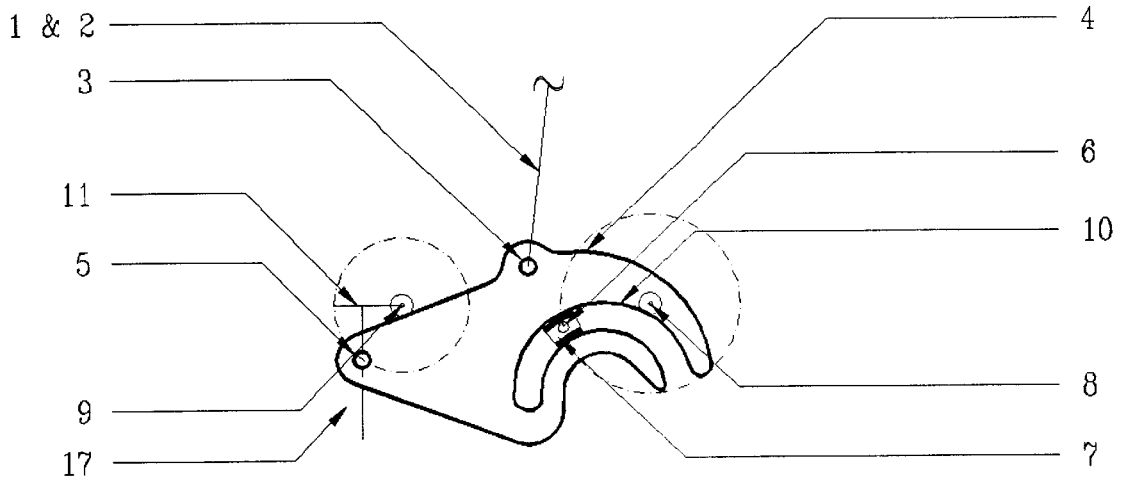
DRAWING 5
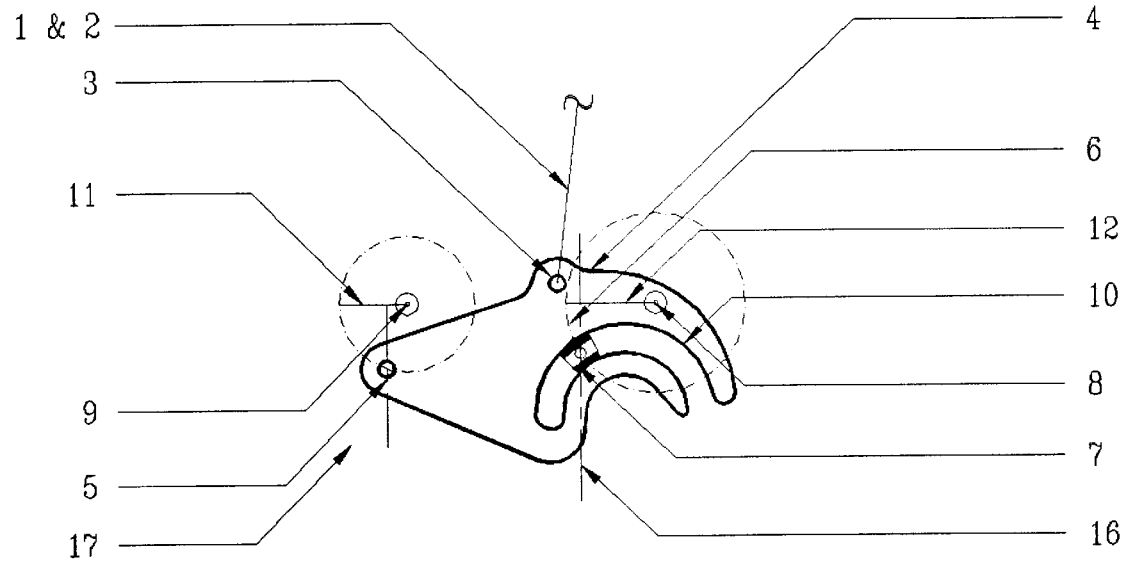
DRAWING 5A

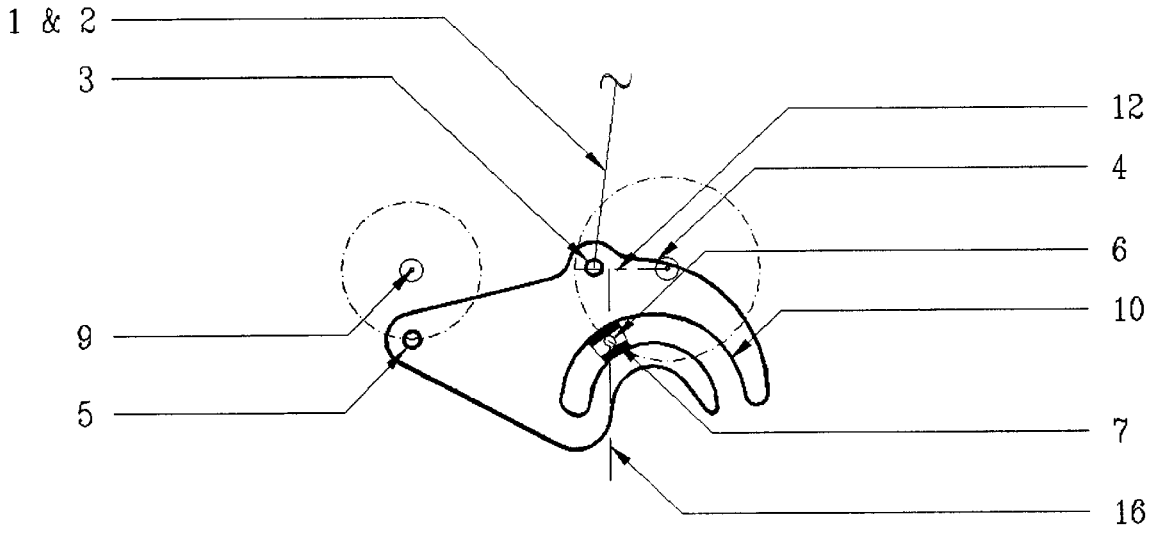
DRAWING 6
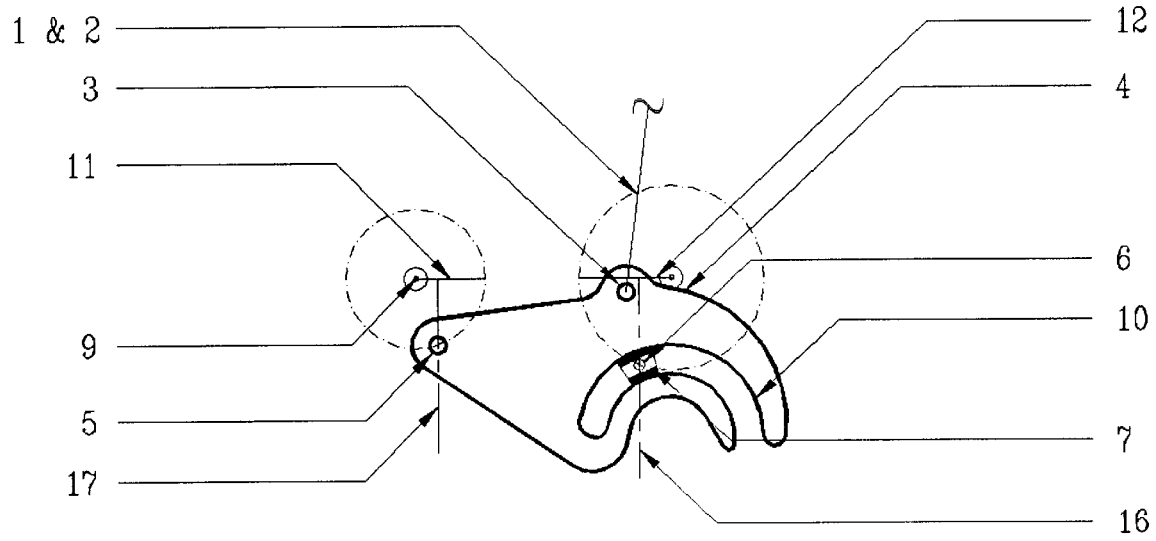
DRAWING 6A

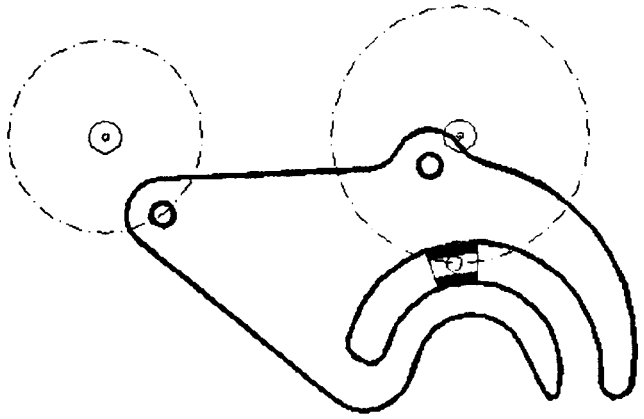
DRAWING 7
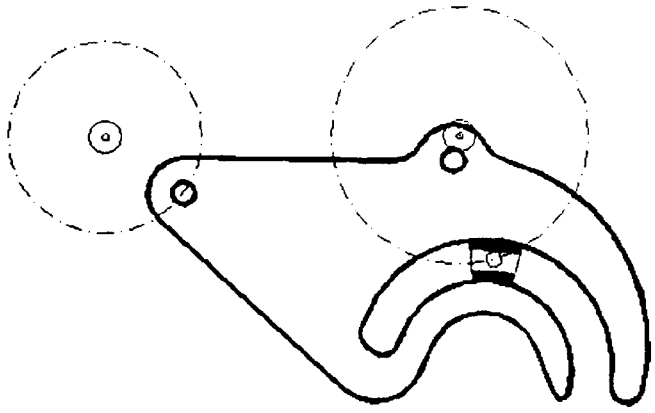
DRAWING 7A

DOUBLE SHAFT HIGH TORQUE ENGINE

BACKGROUND

The cross shaft is the background for this invention. The cross shaft has a slot in one end where a crankshaft journal is mounted with a distance compensator which travels in the slot.

Because of the way the cross shaft is formed, it can be energized by a standard internal combustion piston and connecting rod 18 degrees before the crank reaches top dead center. At this position, the engine gives a good amount of usable torque.

The other end of the cross shaft is secured to a crankshaft. This crankshaft has to be timed with the compensated crankshaft. The length of the radius on the two crankshafts, the timing of the two crankshafts, and the form of the cross shaft slot will govern the torque characteristics of the engine. This gives the advantage of a longer crankshaft power stroke per length of piston travel than any other engine.

The improvement of performance bit the distance compensated cross shaft engine over the way engines are being made today should be numerous. The reason for presenting this invention is because it should gennerate more horsepower while using less fuel, it will produce a cleaner exhaust. It should produce more horsepower because it has a longer distance on the crank travel on which power is applied.

There is more fuel economy because the longer power distance on the crank travel is done with a piston travel shorter than the longer power distance on the crank travel. A cleaner exhaust because of a longer time the burning fuel will stay in the combustion cylinder.

The difference between my invention and the Mandella invention is that before top dead center, my engine can start the power stroke. My engine at this advanced firing position has a large amount of usable torque. Mandella, at top dead center position, has a zero torque situation.

No other piston driven engine has torque as far ahead of top dead center position as my invention. This is a huge advantage for power and economy. My invention is very different than the Mandella invention. Because mine has less moving parts and the parts are totally different than the Mandella parts.

The concept of my invention is for torque and economy and not for inventing a mechanical adjustment for piston height. The new idea in my invention is the cross shaft with a slot wherein the distance compensator runs. This is what sets my invention apart from all the other multi-shaft engine inventions. The cross shaft concept is the invention. No other engine patent has the cross shaft with a slot and distance compensator concept. No other engine patent can give an engine the same advantages and characteristics as the cross shaft, slot, and distance compensator concept.

This is design gives many opportunities for different motor characteristics. These can be brought about by different cross shaft angles and curves in the distance compensator slot. The best part of the cross shaft invention is that it can apply usable torque to the crankshaft before top dead center.

The cross shaft can apply a changing attitude of push on the crank journal through the power stroke which applies power to turning the crank rather than stressing the engine block.

SUMMARY

This invention is basically to bring about a significant change in the way engines are built and operate. This invention should give engineers the ability to choose out of a longer time period on the crank circle to mix the fuel with air. The engineers should be able to use this attribute of the invention to achieve a burn of the fuel air mixture that would have a cleaner exhaust.

This same period advantage should give greater fuel efficiency per horsepower produced. This invention gives the engineers many options for adjusting the engine to meet the needs of what they are trying to achieve. The invention gives the engineers flexibility in being able to change dimensions of the essential components to bring about wanted results not attainable in any other type of engine.

The advanced timing of applying torque and the better angle of applying the torque all through the power stroke accomprished by the cross shaft design sets this engine apart from all other engines.

BRIEF DESCRIPTION

For the purpose of describing the invention, the parts are numbered in the drawings. The invention is a new way to apply power to the rotation of crankshafts in an engine.

To get a more clear understanding of how the invention works, seven pages of drawings are included to depict one revolution of the crankshafts (8) and (9).

Drawing No. 1 has crank (9) at 18 degrees past top dead center and crank (8) is 18 degrees before top dead center at position to fire. At this position, crank (9) has torque line 17 positioned on 20% of crank radius line 11. Crank (8) has torque line 16 positioned on 50% of crank radius line 12.

Drawings 2 through 6A portray the progression of the cross shafts' application of torque to the crankshafts.

Drawing 7 and 7A show the cross shafts' return to top position.

DESCRIPTION

The power is applied by a conventional piston (1) to the connecting rod (2) secured by connecting rod pin (3) to a cross shaft (4). One end of the cross shaft is secured to crankshaft journal (5) on crankshaft (9). The other end of cross shaft (4) and its workings are basically the invention.

This end of the cross shaft (4) is not attached securely, but has a slot (10) in which the distance compensator (7) moves back and forth. Distance compensator (7) is attached to crankshaft journal (6) on crankshaft (8). Crankshafts (8) and (9) each have an idenitical gear (13) and (15) on the end of the shaft; with another identical gear (14) between the two crankshaft gears (13) and (15), to rotate both crankshafts (8) and (9) in the same direction and at the same revolutions per minute. The crankshafts (8) and (9) are timed by the setting of the three gears (13), (14), and (15).

Drawing 6A has crank (9) at 198 degrees and at an adverse position for down pressure from the piston. But, being as the cross shaft (4) has moved toward crank (8), the piston (1) is 90% closer to being straight over crank journal (6) than being over crank journal (5). In this position, crank journal (6) receives 90% of piston (1) energy and crank journal (5) receives 10%. The 10% is further diminished because crank (9) has a 25% shorter raidius than crank (8). So, with crank (8) at 162 degrees and torque line 16 on 25% of crank radius line 12 minus the diminished 10% which would come to about 8%, it still should leave usable torque of 17% on the crank torque line 12. Somewhere between 162 degrees and 180 degrees on crank (8), the power stroke would be over.

The engine can be set up for performance in numerous ways. The example drawings are just my choice of one way to set up the engine. The radius 11 on crankshaft (9) is 25% shorter than the radius 12 on the compensated crankshaft (8). Crankshaft (9) is 36 degrees advanced past crankshaft (8). The power stroke can start on crankshaft (9) at 6 degrees to 18 degrees past top dead center and 30 degrees to 18 degrees before top dead center on crankshaft (8).

The curved slot (10) pushing on the side of distance compensator (7) will push crankshaft (8) sideways in the direction of rotation.

Getting the 30 degree to 18 degree advantage on the power stroke on crankshaft (8) is one of the bigger factors anticipated. As the power stroke progresses to its lower half, the curve of slot (10) continues to change the attitude of the distance compensator (7) to a more efficient angle of push on crankshaft (8).

This invented way of applying force to a crankshaft should produce more usable torque per unit of fuel expended than any other engine invented.

I claim:

1. An engine comprising:

a piston adapted to reciprocate within a cylinder, two parallel crankshafts adapted to rotate in the same direction, a cross shaft connected at one end to a first of said crankshafts by a journal and having a slot in which a distance compensator oscillates, said compensator is mounted on a journal connected to a second of said crankshafts, and a connecting rod attached at one end to said piston and at the other end to an intermediate portion of said cross shaft.

2. The engine of claim 1 wherein said slot is curved.

3. The engine of claim 1 wherein said first crankshaft is advanced with respect to said second crankshaft, and gear means are located at ends of said crankshafts for keeping said crankshafts rotating in the same direction and at the same speed.

4. The engine of claim 1 wherein said journal on said first crankshaft is located at a radius less than a radius of the journal on said second crankshaft.

* * * * *